US009561936B2

(12) United States Patent
Miller et al.

(10) Patent No.: US 9,561,936 B2
(45) Date of Patent: Feb. 7, 2017

(54) ELEVATOR SYSTEM DOOR FRAME THAT SUPPORTS GUIDE RAILS

(75) Inventors: Robin Mihekun Miller, Glastonbury, CT (US); Leandre Adifon, Farmington, CT (US); Mark Steven Thompson, Tolland, CT (US); Harold Terry, Avon, CT (US); Richard J. Ericson, Southington, CT (US); Stephen R. Nichols, Unionville, CT (US); Daryl J. Marvin, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 1112 days.

(21) Appl. No.: 13/201,680

(22) PCT Filed: Mar. 13, 2009

(86) PCT No.: PCT/US2009/037083

§ 371 (c)(1), (2), (4) Date: Aug. 16, 2011

(87) PCT Pub. No.: WO2010/104514

PCT Pub. Date: Sep. 16, 2010

(65) Prior Publication Data

US 2011/0297488 A1 Dec. 8, 2011

(51) Int. Cl.
*B66B 13/30* (2006.01)
*B66B 7/02* (2006.01)

(52) U.S. Cl.
CPC ..... *B66B 13/306* (2013.01); *B66B 7/023* (2013.01); *Y10T 29/49826* (2015.01)

(58) Field of Classification Search
CPC ..... B66B 7/023; B66B 7/024; B66B 7/026; B66B 7/027; B66B 13/30; B66B 13/306; B66B 19/002
USPC ..... 187/406, 408, 325, 900; 104/127; 52/745.1, 745.11, 745.12, 745.13, 745.14, 52/745.18, 745.2
See application file for complete search history.

(56) References Cited

U.S. PATENT DOCUMENTS

| | | | | | |
|---|---|---|---|---|---|
| 156,541 | A | * | 11/1874 | Conrad et al. | 187/241 |
| 585,222 | A | * | 6/1897 | McCool | 187/408 |
| 1,083,508 | A | * | 1/1914 | Schlosser et al. | 187/408 |
| 2,660,263 | A | * | 11/1953 | Raddatz et al. | 187/244 |
| 3,601,938 | A | * | 8/1971 | Loomis | 52/29 |
| 3,686,808 | A | | 8/1972 | Loomis | |

(Continued)

FOREIGN PATENT DOCUMENTS

| | | | |
|---|---|---|---|
| DE | 20105144 | U1 | 7/2001 |
| EP | 0621224 | A2 | 10/1994 |

(Continued)

OTHER PUBLICATIONS

Manual 208—Peelle Co., Frame Installation Manual Freight Doors—2002, 5 pages.

(Continued)

*Primary Examiner* — Minh Truong
(74) *Attorney, Agent, or Firm* — Carlson, Gaskey & Olds

(57) ABSTRACT

An exemplary elevator door frame includes a sill member and a header member. A plurality of jamb members are generally perpendicular to the sill member and the header member. A plurality of guide rail brackets are supported on at least one of the sill member, the header member or one of the jamb members. The guide rail brackets are configured to receive a portion of a guide rail.

20 Claims, 2 Drawing Sheets

(56) References Cited

U.S. PATENT DOCUMENTS

| | | | | |
|---|---|---|---|---|
| 3,741,351 | A | 6/1973 | Suozzo | |
| 3,771,268 | A | 11/1973 | Loomis | |
| 3,881,575 | A | 5/1975 | Manaugh | |
| 3,948,358 | A | 4/1976 | Atkey | |
| 4,231,148 | A | 11/1980 | Harding | |
| 4,550,806 | A * | 11/1985 | Bocker | 187/246 |
| 4,793,441 | A | 12/1988 | Cilderman et al. | |
| 4,830,141 | A * | 5/1989 | Montaigne | A62B 1/04 182/141 |
| 5,427,205 | A | 6/1995 | Saillio et al. | |
| 5,479,754 | A | 1/1996 | Pelvilain et al. | |
| 5,520,264 | A | 5/1996 | Korhonen | |
| 5,901,814 | A | 5/1999 | Adifon et al. | |
| 6,098,759 | A * | 8/2000 | Rossman et al. | 187/272 |
| 6,193,018 | B1 | 2/2001 | Schroder-Brumloop et al. | |
| 6,202,798 | B1 | 3/2001 | Friedman et al. | |
| 6,230,846 | B1 | 5/2001 | Namba et al. | |
| 6,446,762 | B1 | 9/2002 | St. Pierre et al. | |
| 6,481,538 | B2 | 11/2002 | Blackaby et al. | |
| 6,494,001 | B1 | 12/2002 | Ketonen et al. | |
| 6,651,780 | B1 | 11/2003 | Hakala et al. | |
| 6,672,013 | B1 | 1/2004 | Glassey et al. | |
| 6,848,543 | B2 | 2/2005 | Adifon et al. | |
| 6,938,380 | B2 | 9/2005 | Friedman et al. | |
| 7,147,086 | B2 | 12/2006 | Ach | |
| 7,267,200 | B2 | 9/2007 | Orrman | |
| 7,788,854 | B2 * | 9/2010 | Friedman et al. | 52/30 |
| 2006/0054419 | A1 | 3/2006 | Friedman et al. | |
| 2009/0065310 | A1 | 3/2009 | Flynn et al. | |
| 2012/0048654 | A1 * | 3/2012 | Steward | 187/245 |

FOREIGN PATENT DOCUMENTS

| | | | |
|---|---|---|---|
| EP | 1295839 | A1 | 3/2003 |
| JP | S58-87764 | U | 6/1983 |
| JP | 58151166 | | 10/1983 |
| JP | S59159676 | U | 10/1984 |
| JP | 199012875 | | 3/1990 |
| JP | 4354782 | | 12/1992 |
| JP | H0725565 | A | 1/1995 |
| JP | 11171430 | A | 6/1999 |
| JP | 2000016733 | A | 1/2000 |
| JP | 200072354 | | 3/2000 |
| JP | 2003089490 | A | 3/2003 |
| WO | 2006082786 | A1 | 8/2006 |

OTHER PUBLICATIONS

Noriago Elevator Brochure Mar. 1995; 12 pages.

Noriago Elevator Drawings; 7 pages.

Otis, Home Elevator, New Noriai-go Wide 20 Installation and Adjustment Manual; 119 pages.

International Search Report and Written Opinion of the International Searching Authority for International application No. PCT/US2009/037083 mailed Apr. 7, 2010.

International Preliminary Report on Patentability for International application No. PCT/US2009/037083 mailed Sep. 22, 2011.

Chinese Search Report for Application No. 200980158048.2 dated Jul. 24, 2013.

International Search Report and Written Opinion of the International Searching Authority for International Application No. PCT/US2009/037091 mailed Dec. 4, 2009.

Search Report for CN Application No. 200980158047.8 dated Mar. 13, 2009.

International Preliminary Report on Patentability for International Application No. PCT/US2009/037091 mailed Sep. 22, 2011.

Extended European Search Report for Application No. EP 09 84 1627 dated May 9, 2016.

Extended European Search Report for Application No. EP 09 84 1626 dated May 9, 2016.

State Intellectual Property Office of People's Republic China, Supplementary Search for Application No. 200980158048.2 dated Aug. 29, 2014.

* cited by examiner

ELEVATOR SYSTEM DOOR FRAME THAT SUPPORTS GUIDE RAILS

BACKGROUND

Elevator systems typically include a car that travels vertically within a hoistway to carry passengers, cargo or both between various levels in a building. The path the car follows is established, in part, by guide rails that are installed in a hoistway. Installing the guide rails and aligning them in proper position within a hoistway is one of the more time-consuming aspects of installing an elevator system. Guide rails must be aligned relative to each other and vertically plumbed within the hoistway, for example. Additionally, the guide rail positions must be set relative to entranceways that are installed at each landing along the hoistway.

The relative positions of the guide rails and the entranceways establishes the position of the elevator car relative to the entranceways at each landing. Having appropriate alignment at those locations is necessary to achieve adequate door engagement between the elevator car doors and the hoistway doors. Additionally, the elevator car must be precisely positioned relative to the landings to facilitate passenger movement between the landings and the interior of the elevator car. There must be sufficient clearance and alignment in order for the elevator car to be able to move through the hoistway while still keeping a small enough gap between the elevator car structure and the entranceway structures.

There have been suggestions for various structures to facilitate mounting car guide rails relative to elevator entranceways. Some such arrangements include a bracket that extends from the entranceway along a sidewall of the hoistway where a guide rail should be positioned. One such example is shown in U.S. Pat. No. 7,147,086. A tool that is useful for positioning guide rails based on doorways is shown in the Published Application WO 2006/054982.

SUMMARY

An exemplary elevator door frame includes a sill member, a header member and a plurality of jamb members. A plurality of guide rail brackets are supported on at least one of the sill member, the header member or one of the jamb members. The guide rail brackets are configured to receive a portion of a guide rail.

An exemplary elevator system includes a hoistway. A plurality of door frames including a sill member, a header member and jamb members are supported at selected locations along a selected wall of the hoistway such that there is vertical spacing between one of the header members at a first landing and an adjacent one of the sill members at a second, different landing. A plurality of guide rails are supported by the door frames in desired positions along the selected wall.

An exemplary method of installing elevator system components includes installing door frames that each have a header member, a sill member and jamb members in selected locations along a selected wall of a hoistway. Guide rails are secured in desired positions along the selected wall by supporting the guide rails on the installed door frames.

The various features and advantages of the disclosed examples will become apparent to those skilled in the art from the following detailed description. The drawings that accompany the detailed description can be briefly described as follows.

DETAILED DESCRIPTION

Figure 1:
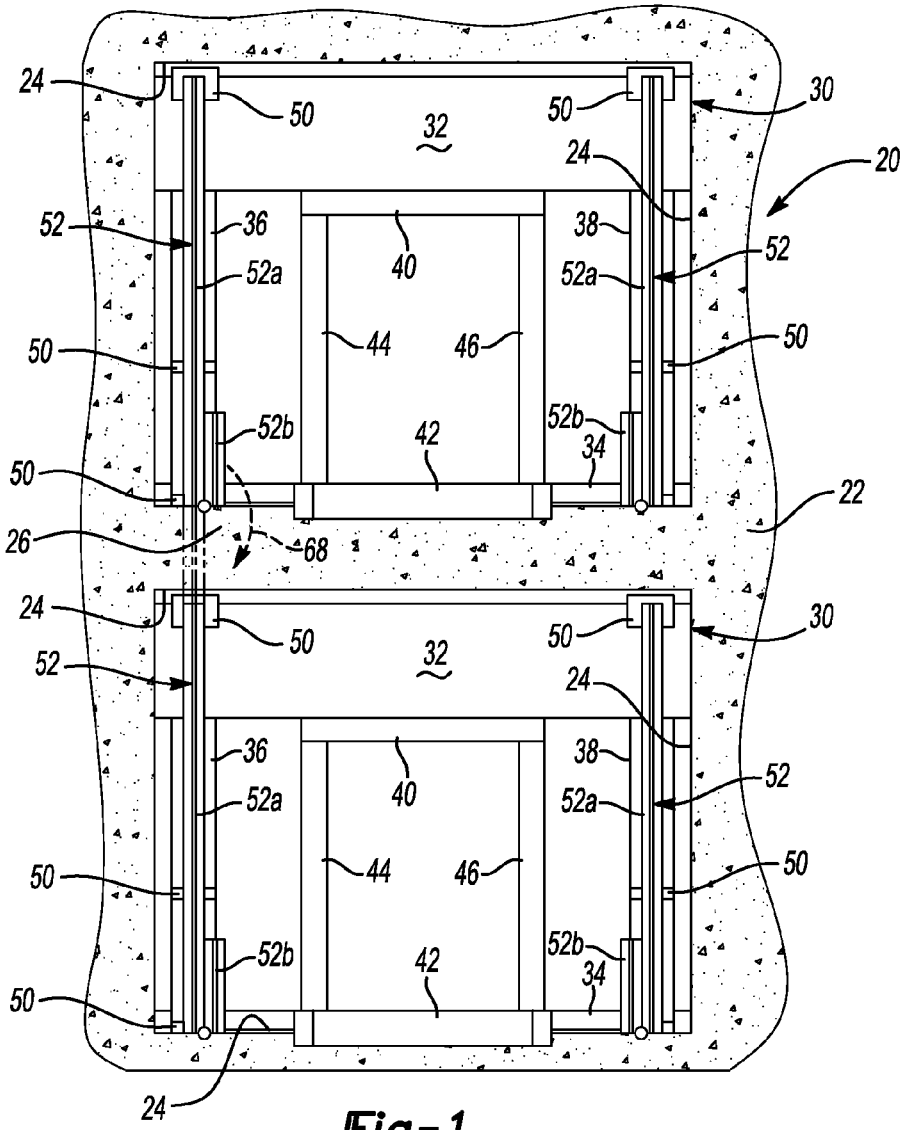
FIG. 1 schematically illustrates selected portions of an example elevator system including door frames designed according to an embodiment of this invention.

FIG. 1 schematically shows selected portions of an elevator system 20. A wall 22 of a hoistway includes a plurality of openings 24 that are useful for establishing access points to the elevator system from landings or building floors 26. The illustration in FIG. 1 is seen from a perspective inside of the hoistway and the example hoistway wall 22 is a front wall of the hoistway.

A door frame 30 is associated with each opening 24. In the illustrated example, each door frame includes a main header 32, a main sill 34 and jamb members 36 and 38. A finish doorway is established in this example, in part, by a door header 40, a door sill member 42 and door jambs 44 and 46. As can be appreciated from the illustration, the headers and sills are horizontally oriented while the jamb members are all vertically oriented.

The door frames 30 include guide rails brackets 50 for securing guide rails 52 in desired locations in the hoistway. The guide rails 52 are supported directly by the door frames 30 by being mounted on or secured to at least one of a header 32, 40, a sill 34, 42 or a jamb member 36, 38, 44, 46. The guide rail brackets 50 in this example are secured to the main header 32, the sill 34 and the jamb members 36 and 38.

Figure 2:
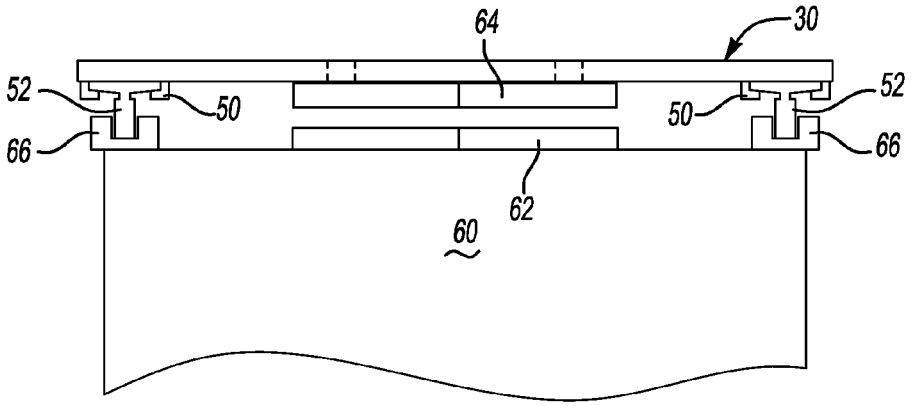
FIG. 2 is a top, elevational view of selected portions of the example of FIG. 1.

As can be appreciated from FIG. 2, this position of the guide rails 52 places them near an outside edge of a front of an elevator car 60. Elevator car doors 62 are supported for movement in a known manner along the front of the elevator car 60. The elevator car doors 62 interact with hoistway doors 64 supported at each of the landings for movement relative to a corresponding door frame 30. As shown schematically in FIG. 2, guiding devices 66 follow along the guide rails 52 for guiding movement of the elevator car 60. The guiding devices 66 may comprise rollers or sliding members as known in the art.

Figure 3:
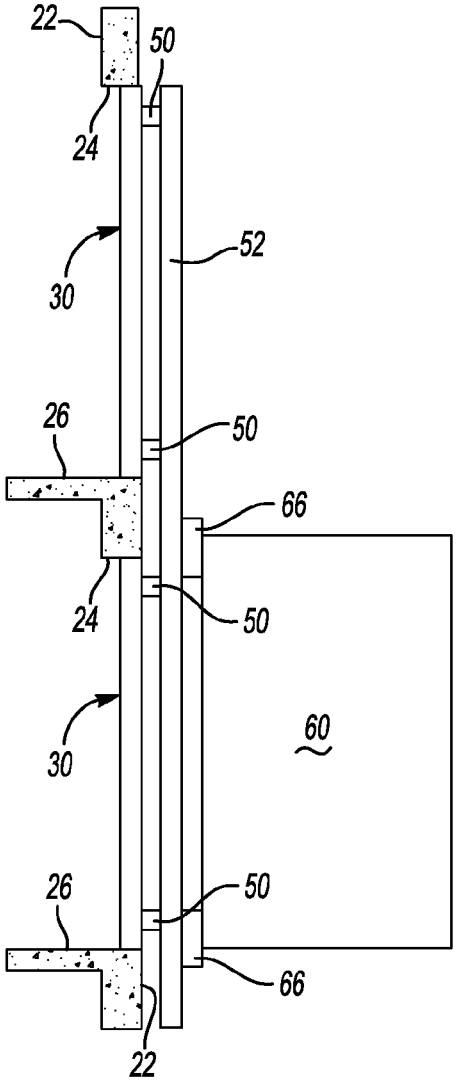
FIG. 3 is an elevational view of selected portions of an example elevator system arrangement.

As can be appreciated from FIGS. 2 and 3, the guide rails 52 are along the front wall 22 or surface of the hoistway, which is the wall facing the car doors 62 on the elevator car 60. Providing the guide rails on the front wall is unique as most elevator systems position guide rails on the sides of the elevator car. Providing the guide rails in the position of the illustrated example facilitates supporting the guide rails directly by the door frames 30 by securing or mounting the guide rails to one of the door frame members (e.g., the header, sill or jamb members).

Supporting the guide rails directly on the door frames 30 introduces efficiencies and enhances economies associated with elevator system installation. With the illustrated example, it is no longer required to separately align guide rails and doorways along the hoistway. Once the door frames 30 are set in position, the alignment of the guide rails 52 is automatically established. Having the guide rail brackets 50 positioned on the door frames 30 prior to installation of the door frames allows for automatically establishing an alignment of the brackets 50 upon aligning at least two door frames 50, which facilitates automatically aligning the guide rails 52 in their desired positions relative to the entrances established by the door frames 30.

FIG. 1 schematically shows one example arrangement in which the guide rails 52 comprise a plurality of sections. Each door frame 30 has two associated sections that can be pre-mounted to the door frames 30 prior to installation. In the example of FIG. 1, each guide rail section includes a first portion 52*a* that remains fixed relative to the door frame 30 and a second portion 52*b* that is moveable relative to the first portion 52*a*. As schematically shown by the arrow 68, the second portions 52*b* are moveable about a hinge or pivot point from a position (illustrated in FIG. 1) that is useful for shipping and installation of the door frame 30 into an installed position (shown in phantom) in which the second portion 52*b* is aligned with the remainder of the guide rail 52.

In the example of FIG. 1, the second portions 52*b* effectively extend the length of the guide rail section associated with each door frame 30. The second portions 52*b* span a gap or spacing between adjacent guide rail sections associated with adjacent door frames 30. In particular, the second portions 52*b* of one guide rail section contacts a first (e.g., fixed) portion 52*a* of a vertically adjacent guide rail section when the second portion 52*b* is moved into the position aligned with its corresponding first portion of that guide rail section.

The brackets 50 in this example are strategically positioned to secure the second portions 52*b* in the aligned, installed positions (shown in phantom in FIG. 1) for purposes of completing the installation of the guide rails 52.

In another example, as schematically shown in FIG. 3, the guide rails 52 have longer sections that span more than one entranceway or door frame 30 in a vertical direction. In some examples, the guide rails 52 span the entire length of the hoistway in a conventional manner. For such an example, the guide rail brackets 50 are pre-installed on the door frames 30 to establish the desired alignment of the guide rails 52. Once a sufficient number of the door frames 30 have been installed, the guide rails 52 having sections that are longer than the height of any one of the door frames 30 can then be installed within the hoistway.

Figure 4:
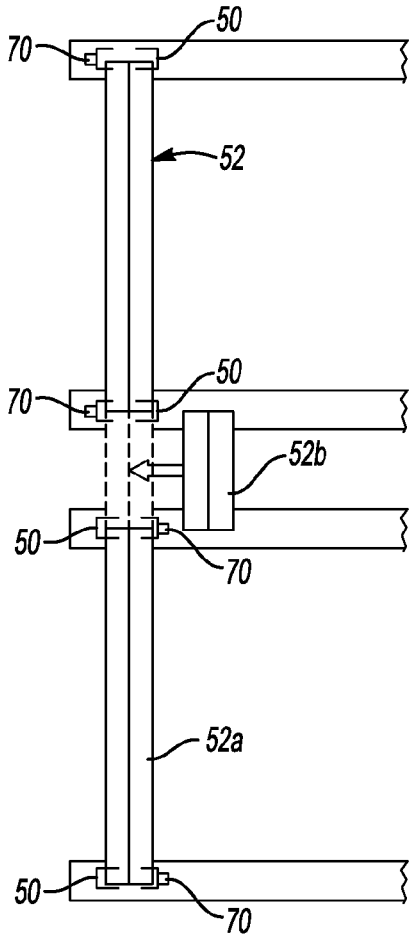
FIG. 4 schematically illustrates a portion of an exemplary installation procedure.

In the example of FIG. 4, the second portions 52*b* are not secured to the fixed portions of the guide rail sections that are supported on the corresponding door frame 30 prior to installation of the door frame 30. In this example, the second portions 52*b* are separate pieces that are moved into the position (shown in phantom) to span the gap or spacing between adjacent guide rail sections.

Another feature of the example of FIG. 4 is adjustment members 70 such as jack-screws that allow for adjusting the position of the brackets 50 relative to the corresponding door frame 30 (or to adjust the position of a door frame member) to accommodate for any misalignment issues presented during installation of the individual door frames 30. Such fine-tuning adjustments are more readily accomplished than the multiple adjustments required when attempting to install elevator guide rails in a conventional fashion.

One of the features of the disclosed examples is that the robustness of each guide rail bracket 50 is consistent along the hoistway since they are preassembled onto the corresponding door frame members at a factory, for example. This is in contrast to conventional arrangements where guide rail brackets are secured to hoistway walls along the height of the hoistway and there may be variations in the robustness of the installation of each bracket due to the condition of the hoistway walls or installer ability.

Another feature of the disclosed examples is that once at least some of the door frames 30 are installed and aligned, the guide rails 52 are automatically aligned by association with the door frames 30. It is possible as in some of the illustrated arrangements to have guide rail sections preinstalled on the door frames, which can facilitate faster installation time. One of the main features of the disclosed examples is that they significantly reduce the amount of time it takes to install an elevator system by eliminating the time-consuming difficulties and procedures that were required when installing guide rails in a conventional manner.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator door frame, comprising:

a frame sill member;

a frame header member;

a plurality of frame jamb members between the sill member and the header member;

a door sill member;

a door header member;

door jamb members between the door sill member and the door header member;

a plurality of guide rail brackets supported on at least one of the frame sill member, frame header member or one of the frame jamb members; and at least one guide rail section secured in a selected position relative to the door frame by the guide rail brackets, the at least one guide rail section being distinct from the frame jamb members and the door jamb members.

2. The elevator door frame of claim 1, comprising at least four guide rail brackets wherein two of the brackets are on one side of an opening defined by the door frame and two others of the brackets are on an opposite side of the opening such that the brackets are arranged to receive guide rail portions of a guide rail on each side of the opening.

3. The elevator door frame of claim 1, wherein the guide rail section comprises a first portion that remains in a fixed position relative to the door frame and a second portion that is moveable relative to the first portion.

4. The elevator door frame of claim 3, wherein the second portion is moveable into a position aligned with the first portion and the second portion effectively increases a length of the guide rail section relative to the door frame when the second portion is aligned with the first portion.

5. An elevator system in a hoistway, comprising:

a plurality of door frames including a frame sill member, a frame header member and frame jamb members associated with the frame header member and the frame sill member, the door frames including a door sill member, a door header member and door jamb members associated with the door header member and the door sill member, the door frames being supported at selected locations along a selected wall of the hoistway such that there is vertical spacing between one of the frame header members at a first landing and an adjacent one of the frame sill members at a second, different landing; and a plurality of guide rails supported by the door frames in selected positions along the selected wall, wherein the guide rails are distinct from the frame jamb members and the door jamb members.

6. The elevator system of claim 5, comprising a plurality of guide rail brackets supported on each of the door frames, the guide rails being secured in the selected positions by the guide rail brackets.

7. The elevator system of claim 5, wherein the guide rails are secured directly to one of the frame members of the door frames.

8. The elevator system of claim 5, wherein the guide rails each comprise a plurality of guide rail sections and each of the sections is supported by a corresponding one of the door frames.

9. The elevator system of claim 8, wherein the guide rail sections each comprise a first portion that remains in a fixed position relative to the corresponding door frame and a second portion that is moveable relative to the first portion.

10. The elevator system of claim 9, wherein the second portion is moveable into a position aligned with the first portion, the second portion of one guide rail section contacts the first portion of a vertically adjacent guide rail section when in the position aligned with the first portion.

11. The elevator system of claim 10, wherein the second portion is hinged to the first portion.

12. The elevator system of claim 5, wherein a position of each door frame is selected relative to the selected wall of the hoistway to thereby automatically align the guide rails in a desired orientation in the hoistway upon installation of the door frames.

13. A method of installing elevator system components, comprising the steps of:

installing frames that each include a frame header member, a frame sill member and frame jamb members in selected locations along a selected wall of a hoistway;

situating a door header, a door sill and door jambs on the installed frames, respectively; and securing guide rails in selected positions along the selected wall by supporting the guide rails on the installed frames.

14. The method of claim 13, comprising securing guide rail brackets to selected frame members of the frames; and securing the guide rails to the guide rail brackets.

15. The method of claim 14, comprising securing the guide rail brackets before installing the frames.

16. The method of claim 15, comprising securing sections of the guide rails to the frames before installing the frames.

17. The method of claim 13, comprising securing guide rail sections to each of the door frames before installing the door frames; and connecting the guide rail sections to each other.

18. The method of claim 17, wherein the guide rail sections each comprise a first portion that remains in a fixed position relative to the corresponding frame and a second portion that is moveable relative to the first portion and the method comprises moving the second portion into a position aligned with the first portion such that the second portion of one guide rail section contacts a first portion of a vertically adjacent guide rail section when in the position aligned with the first portion.

19. The method of claim 18, wherein the second portion is hinged to the first portion.

20. The method of claim 13, comprising selecting a position of each frame relative to the selected wall of the hoistway to thereby automatically align the guide rails in a selected orientation in the hoistway upon installation of the frames.

* * * * *